US006835863B2

(12) United States Patent
Chester et al.

(10) Patent No.: US 6,835,863 B2
(45) Date of Patent: Dec. 28, 2004

(54) CATALYTIC PRODUCTION OF LIGHT OLEFINS FROM NAPHTHA FEED

(75) Inventors: Art W. Chester, Cherry Hill, NJ (US); Ke Liu, East Longmeadow, MA (US); Robert A. Ware, Wyndmoor, PA (US)

(73) Assignee: ExxonMobil Oil Corporation, Irving, TX (US)

( * ) Notice: Subject to any disclaimer, the term of this patent is extended or adjusted under 35 U.S.C. 154(b) by 327 days.

(21) Appl. No.: 09/351,147

(22) Filed: Jul. 12, 1999

(65) Prior Publication Data

US 2001/0053868 A1 Dec. 20, 2001

(51) Int. Cl.[7] ..... C07C 4/06; C10G 11/05; C10G 35/06

(52) U.S. Cl. ..... 585/651; 585/648; 585/649; 585/650; 585/653; 208/120.01; 208/135

(58) Field of Search ..... 585/648, 649, 585/650, 651, 653; 208/120.01, 135

(56) References Cited

U.S. PATENT DOCUMENTS

| | | | | |
|---|---|---|---|---|
| 3,911,041 A | | 10/1975 | Kaeding et al. | 260/682 |
| 3,939,058 A | | 2/1976 | Plank et al. | 208/120 |
| 3,972,832 A | | 8/1976 | Butter et al. | 252/437 |
| 4,141,859 A | | 2/1979 | Plank et al. | 252/455 |
| 4,171,257 A | | 10/1979 | O'Rear et al. | 208/120 |
| 4,251,348 A | | 2/1981 | O'Rear et al. | 208/61 |
| 4,282,085 A | | 8/1981 | O'Rear et al. | 208/120 |
| 4,347,121 A | | 8/1982 | Mayer et al. | 208/58 |
| 4,390,413 A | | 6/1983 | O'Rear et al. | 208/61 |
| 4,423,266 A | | 12/1983 | Young | 585/481 |
| 4,436,614 A | | 3/1984 | Olbrich et al. | 208/89 |
| 4,502,945 A | | 3/1985 | Olbrich et al. | 208/120 |
| 4,582,815 A | | 4/1986 | Bowes | 502/64 |
| 4,590,321 A | | 5/1986 | Chu | 585/415 |
| 4,918,256 A | | 4/1990 | Nemet-Mavrodin | 585/415 |
| 4,980,053 A | | 12/1990 | Li et al. | 208/120 |
| 5,019,664 A | | 5/1991 | Del Rossi et al. | 585/419 |
| 5,026,936 A | | 6/1991 | Leyshon et al. | 585/315 |
| 5,053,374 A | | 10/1991 | Absil et al. | 502/64 |
| 5,171,921 A | | 12/1992 | Gaffney et al. | 585/653 |
| 5,182,242 A | | 1/1993 | Marler | 502/66 |
| 5,292,976 A | | 3/1994 | Dessau et al. | 585/322 |
| 5,348,643 A | | 9/1994 | Absil et al. | 208/114 |
| 5,380,690 A | | 1/1995 | Zhicheng et al. | 502/65 |
| 5,389,232 A | | 2/1995 | Adewuyi et al. | 208/120 |
| 5,456,821 A | | 10/1995 | Absil et al. | 208/114 |
| 5,472,594 A | | 12/1995 | Tsang et al. | 208/114 |
| 5,637,207 A | | 6/1997 | Hsing et al. | 208/164 |
| 5,670,037 A | | 9/1997 | Zaiting et al. | 208/114 |
| 5,898,089 A | | 4/1999 | Drake et al. | 585/418 |
| 5,997,728 A | * | 12/1999 | Adewuyi et al. | 208/120.01 |
| 6,069,287 A | * | 5/2000 | Ladwig et al. | 585/648 |

FOREIGN PATENT DOCUMENTS

| | | | |
|---|---|---|---|
| EP | 0 323 736 | 7/1989 | |
| EP | 0323736 A2 | 7/1989 | C10G/35/095 |
| EP | 0 347 003 B1 | 12/1989 | |
| EP | 0 372 632 B1 | 6/1990 | |
| EP | 0 385 538 A1 | 9/1990 | |
| EP | 0 385 538 B1 | 9/1990 | |
| EP | 0 490 435 B1 | 6/1992 | |
| WO | WO 98/03612 | 1/1998 | |

OTHER PUBLICATIONS

International Search Report, Oct. 13, 2000.

"The Paragon Process: A New Hydrocracking Concept", D. J. O'Rear, Ind. Eng. Chem. Res. 26:2337–2344 (1987).

"Cracking of FC and Coker Naphthas by ZSM–5 Catalyst and Equilibrium FC Catalyst", Hsing et al., Symposium on Hydrogen Transfer in Hydrocarbon Processing, Div. Of Petroleum Chemistry Inc., 208th Meeting, Am. Chem. Soc. Washington, D.C., p. 388–392 (1994).

"Deep Catalytic Cracking Plant Produces Propylene in Thailand", Oil & Gas Journal, p. 49–53 (1998).

"Deep Catalytic Cracking, Maximize Olefin Production", Chapin et al, NPRA Annual Meeting, AM–94–43, p. 1–14 (1994).

"DCC Flexibility for Isoolefins Production", Li et al., Symposium on Advances in Fluid Catalytic Cracking, Divisio of Petroleum Chemistry, Inc. 206th National Meeting, Am. Chem Soc. Chicago, p. 581–583 (1993).

"DCC—A New Propylene Production Process from Vaccum Gas Oil", Zaiting et al., National Petroleum Refiners Association, AM–90–40, p. 1–14 (1990).

"Commercial Trial of DCC (Deep Catalytic Cracking) Process for Gaseous Olefins Production", Xieqing et al., Research Institute of Pet. Proc., SINOPEC (undated).

"Deep Catalytic Cracking for Light Olefins", Chapin et al., Presented at Fifth World Congress of Chemical Engineering, San Deigo (1996).

* cited by examiner

*Primary Examiner*—Walter D. Griffin

(57) ABSTRACT

A $C_4$+ naphtha hydrocarbon feed is converted to light olefins and aromatics, by contacting the feed with a catalyst containing ZSM-5 and/or ZSM-11, a substantially inert matrix material such as silica and/or clay, having less than about 20 wt % active matrix material based on total catalyst composition, and phosphorus.

9 Claims, No Drawings

CATALYTIC PRODUCTION OF LIGHT OLEFINS FROM NAPHTHA FEED

BACKGROUND OF THE INVENTION

The present invention relates to converting a naphtha hydrocarbon feed to produce hydrocarbon compounds containing light olefins and aromatics. In particular, the present invention relates to conversion of a $C_4$+ naphtha feed and includes the use of an intermediate pore zeolite catalyst.

Gasoline is the traditional high value product of fluid catalytic cracking (FCC). Currently however, the demand for ethylene and propylene is growing faster than gasoline and the olefins have higher value per pound than does gasoline. In conventional fluid catalytic cracking, typically less than 2 wt. % ethylene in dry gas is obtained, and it is used as fuel gas. The propylene yield is typically 3–6 wt. %.

Catalytic cracking operations are commercially employed in the petroleum refining industry to produce useful products, such as high quality gasoline and fuel oils from hydrocarbon—containing feeds. The endothermic catalytic cracking of hydrocarbons is most commonly practiced using Fluid Catalytic Cracking (FCC) and moving bed catalytic cracking, such as Thermofor Catalytic Cracking (TCC). In FCC, a cyclic mode is utilized and catalyst circulates between a cracking reactor and a catalyst regenerator. In the cracking reactor, hydrocarbon feedstock is contacted with hot, active, solid particulate catalyst without added hydrogen, for example at pressures up to 50 psig (4.5 bar) and temperatures of about 425° C. to 600° C. As the hydrocarbon feed is cracked to form more valuable products, carbonaceous residue known as coke is deposited on the catalyst, thereby deactivating the catalyst. The cracked products are separated from the coked catalyst, the coked catalyst is stripped of volatiles, usually with steam in a catalyst stripper, and the catalyst is then regenerated. Decoking restores catalyst activity while the burning of the coke heats the catalyst. The heated, regenerated catalyst is recycled to the cracking reactor to crack more feed.

In order to produce higher yields of light olefins, e.g. propylene and butylene, in conventional FCC reactors, the trend has been to dilute phase riser cracking with a brief hydrocarbon feed residence time of one to ten seconds. In this method, a small amount of diluent, e.g., steam up to 5 wt. % of the feed, is often added to the feed at the bottom of the riser. Dense bed or moving bed cracking can also be used with a hydrocarbon residence time of about 10 to 60 seconds. The FCC process generally uses conventional cracking catalyst which includes large pore zeolite such as USY or REY. A minor amount of ZSM-5 has also been used as an additive to increase FCC gasoline octane. Commercial units are believed to operate with less than 10 wt. % additive, usually considerably less.

U.S. Pat. No. 5,389,232 to Adewuyi et al. describes an FCC process in which the catalyst contains both conventional large pore cracking catalyst and a ZSM-5 additive. The patent indicates that the riser is quenched with light cycle oil downstream of the base to lower the temperature in the riser, since high temperatures degrade the effectiveness of ZSM-5. Although the ZSM-5 and the quench increase the production of $C_3/C_4$ light olefins, there is no appreciable ethylene product.

U.S. Pat. No. 5,456,821 to Absil et al. describes catalytic cracking over a catalyst composition which includes a large pore molecular sieve and an additive of ZSM-5 in an inorganic oxide matrix. The patent teaches that an active matrix material enhances the conversion. The cracking products included gasoline, and $C_3$ and $C_4$ olefins but no appreciable ethylene.

European Patent Specifications 490,435-B and 372,632-B and European Patent Application 385,538-A describe processes for converting hydrocarbonaceous feedstocks to olefins and gasoline using fixed or moving beds. The catalysts included ZSM-5 in a matrix which included a large proportion of alumina.

Although modifying conventional FCC processes to increase light olefin production can increase the yield of ethylene and especially propylene, increasing petrochemical propylene recovery from refinery FCC's competes with alkylation demand. Moreover, the addition of ZSM-5 to the FCC reactor to increase propylene production, not only lowers gasoline yields, but may affect gasoline quality. Thus, many of the proposed modifications to a conventional FCC process will have undesirable effects on motor fuel quality and supply, resulting in the need for additional processing or blending to achieve acceptable motor fuel quality.

Thus, it would be advantageous to upgrade low value refinery streams to ethylene and propylene, while producing high quality motor fuels via conventional FCC processes.

In that regard, other types of processes have been developed for producing olefins from paraffinic feeds such as intermediate distillate, raffinate, naphtha and naphthenes, with olefin production directly or indirectly, as described, for example, in U.S. Pat. No. 4,502,945 to Olbrich et al., U.S. Pat. No. 4,918,256 to Nemet-Mavrodin, U.S. Pat. No. 5,171,921 to Gaffney et al., U.S. Pat. No. 5,292,976 to Dessau et al., and EP 347,003-B. The paraffinic feeds do not contain any significant amount of aromatics. These processes differ not only in feed, but in process conditions, variously including, for example, a requirement for addition of hydrogen (hydrocracking), use of high space velocities, accepting low conversions per pass and use of alumina or other active binders for the catalysts. In addition, little coke is produced on the catalyst so that fuel gas must be burned to generate heat for the endothermic reaction. Furthermore, there is little or no aromatic gasoline range product.

U.S. Pat. No. 4,980,053 to Li et al. describes catalytic cracking (deep catalytic cracking) of a wide range of hydrocarbon feedstocks. Catalysts include pentasil shaped molecular sieves and Y zeolites. Although the composition of the pentasil shape selective molecular sieve (CHP) is not particularly described, a table at column 3 indicates that the pentasil catalyst contains a high proportion of alumina, i.e., 50% alumina, presumably as a matrix. Deep Catalytic Cracking (DCC) is discussed by L. Chapin et al., "Deep Catalytic Cracking Maximizes Olefin Production", as presented at the 1994 National Petroleum Refiners Association Meeting. Using a catalyst of unspecified composition, the process produces light olefins of $C_3$–$C_5$ from heavy feedstocks. See also, Fu et al., Oil and Gas Journal, Jan. 12, 1998, pp 49–53.

It is an object of the invention to provide a catalytic conversion process with increased yield of $C_2$ and $C_3$ olefins and relatively low yield of $C_1$ and $C_2$ paraffins, while also producing useful aromatics.

SUMMARY OF THE INVENTION

The invention includes a process for converting a $C_4$+ naphtha hydrocarbon feed to hydrocarbon products containing light olefins and aromatics by contacting the feed with a catalyst which comprises zeolite ZSM-5 and/or ZSM-11, having an initial silica/alumina ratio below about 70, a substantially inert binder and phosphorus. The contacting is under conditions to produce light olefin product comprising ethylene and propylene and aromatics comprising toluene and xylene.

The zeolite is bound with a substantially inert matrix material. The substantially inert matrix material comprises silica, clay or mixtures thereof. By substantially inert is meant that the matrix preferably includes less than about 20 wt. % active matrix material, more preferably less than 10 wt. % active material based on catalyst composition. Active matrix materials are those which have catalytic activity with non-selective cracking and hydrogen transfer. The presence of active matrix material is minimized in the invention. The most commonly used active matrix material is active alumina. The catalyst composition used in the invention preferably includes less than 20 wt. % alumina, more preferably less than 10 wt. % alumina, or essentially no active alumina. However, non-acidic forms of alumina such as alpha alumina can be used in these small amounts in the matrix. A small amount of alumina may be used to confer sufficient "hardness" in the catalyst particles for resistance to attrition and high temperatures but without introducing any appreciable non-selective cracking or hydrogen transfer.

The conditions minimize hydrogen transfer and it is preferred to avoid hydrogen addition, hydroprocessing and the use of other catalyst components which would introduce excess hydrogen transfer activity. It has also been discovered that the process can be conducted at generally higher temperatures than conventional, commercially practiced fluid catalytic cracking. High temperature operation also increases the rate of conversion to desired products relative to hydrogen transfer. Catalytic conversion conditions include a temperature from about 950° F. (510° C.) to about 1300° F. (704° C.), a hydrocarbon partial pressure from about 2 to about 115 psia (0.1–8 bar), a total system pressure of about 1–10 atmospheres, a catalyst/oil ratio from about 0.01 to about 30, and a WHSV from about 1 to about 20 $hr^{-1}$. In order to provide heat for the endothermic reaction, the catalyst is preferably hot, regenerated catalyst such as may be obtained by continuously circulating from the regenerator.

The products of the catalytic conversion process include light olefins and aromatics, and less than about 10 wt %, preferably less than about 8 wt % and more preferably less than about 6 wt % dry gas (methane and ethane). The product light olefins can include ethylene plus propylene in an amount of at least 20 wt. % based on total product; or at least 25 wt. %, and even up to 30 wt. % or more ethylene plus propylene. The product light olefins contain a significant amount of ethylene relative to propylene, with an ethylene/propylene weight ratio greater than about 0.39, preferably greater than about 0.6.

The process can be practiced in a fluid bed reactor, fixed bed reactor, multiple-fixed bed reactor (e.g. a swing reactor), batch reactor, a fluid catalytic cracking (FCC) reactor or a moving bed catalytic cracking reactor such as Thermafor Catalytic Cracking (TCC). A $C_4$+ naphtha feed is catalytically converted in a catalytic reactor (e.g. an FCC reactor) operating under reaction conditions by contacting the feed with a catalyst containing ZSM-5 and/or ZSM-11, phosphorus and a substantially inert matrix, the contacting producing a product effluent which includes light olefins and aromatics. During the reaction, coke is formed on the catalyst. The product effluent and the catalyst containing coke are separated from each other. The effluent is recovered and the catalyst containing coke is regenerated by contact with oxygen-containing gas to burn off the coke and produce hot, regenerated catalyst and to produce heat for the endothermic reaction. The hot, regenerated catalyst is recycled to the catalytic reactor.

Advantageously, the process produces valuable light olefins and aromatic products useful as petrochemical feedstocks, with a relatively high ethylene to propylene ratio and without producing significant amounts of methane or ethane.

DETAILED DESCRIPTION OF THE INVENTION

In accordance with the present invention, a $C_4$+ naphtha hydrocarbon feed is converted to more valuable light olefins and aromatics. The present process provides not only significantly more ethylene plus propylene, over conventional processes, but provides a product with an ethylene/propylene ratio greater than about 0.39, preferably greater than about 0.6. Typically, increases in ethylene yield are attributable solely to thermal cracking, a reaction sequence that also produces undesirable products such as methane and ethane. However, since the catalyst of the invention has higher activity for light olefin production than conventional FCC catalysts, the process is conducive to operation without the formation of significant undesirable products. Thus, while it is not intended to be bound by theory, it is believed that ethylene can be produced catalytically from a naphtha feed without significant production of dry gas (methane and ethane). In addition to the light olefin production, desirable aromatics are also produced (e.g. toluene and xylene).

Feeds

The feed stock, that is, the $C_4$+ naphtha hydrocarbons, may include straight-run, virgin or cracked stocks such as pyrolysis, coker, catalytic or light catalytic naphthas. The feed stock may include heavy or fall-range naphthas, or any other naphtha containing $C_4$–$C_{12}$ olefins and/or parafins. Preferably, the feed will contain at least 30%, and more preferably at least 50%, by weight of aliphatic hydrocarbons (paraffins and/or olefins) containing 4 to 12 carbon atoms. These feeds are generally lighter than typical FCC feedstocks, for example, deep cut gas oil, vacuum gas oil, thermal oil, residual oil, cycle stock, whole top crude, and the like.

Naphthas useful for the invention include naphthas exhibiting boiling point temperature ranges of up to about 430° F. (221° C.). The light naphtha fraction thereof, exhibiting a boiling point temperature range of from about 80° F. (27° C.) to about 250° F. (121° C.), is particularly useful for the invention. The naphtha feedstock may optionally be hydrotreated prior to converting to reduce or eliminate sulfur, nitrogen and oxygen derivatives of hydrocarbons present in the feedstock as impurities, which may contaminate the product olefins or cause more rapid aging of the catalyst.

Process

Catalytic conversion units which are amenable to the invention can operate at temperatures from about 950° F. (510° C.) to about 1300° F. (704° C.) preferably from about 1000° F. (510° C.) to about 1200° F. (649° C.) and under sub-atmospheric to superatmospheric hydrocarbon partial pressure, usually from about 2 to 115 psia (0.1 to 8 bar), preferably from about 5 to 65 psia (0.3 to 4.5 bar). Because of the differences in the production objective and the catalyst used in the invention relative to conventional FCC catalysts, a higher temperature, higher catalyst/oil ratio, or long residence time as compared with conventional FCC may be utilized to achieve a higher conversion to the desired light olefins and aromatics.

The catalytic process can be either fixed bed, moving bed, transfer line, or fluidized bed, and the hydrocarbon flow can be either concurrent or countercurrent to the catalyst flow. The process of the invention is particularly applicable to a fluidized bed cracking process. In such a process, the $C_4$+ naphtha hydrocarbon feed and catalyst are passed through a reactor, the product and catalyst are separated, the catalyst is stripped of volatiles and the catalyst is regenerated.

In the fluidized bed cracking process, the fluidizable catalyst is a fine powder of about 20 to 140 micrometers. This powder is generally suspended in the feed and propelled upward in a reaction zone. Diluent such as steam or an inert gas may be added to the hydrocarbon feed in an amount of up to about 40 wt %, preferably about 5 to 30 wt %, based upon total weight of the feed, to lower hydrocarbon partial pressure. The amount of diluent can be adjusted, depending on the catalyst and process conditions, to maximize yield and/or selectivity of the desired product(s). A $C_4$+ naphtha hydrocarbon feedstock, e.g., a light catalytic naphtha, is admixed with a suitable catalyst to provide a fluidized suspension and converted in a dense-bed or riser reactor, at elevated temperatures to provide a mixture containing light olefins and aromatics. The gaseous reaction products and spent catalyst are discharged from the reactor into a separator, e.g. a cyclone unit, with the reaction products being conveyed to a product recovery zone and the spent catalyst entering a catalyst bed stripper. In order to remove entrained hydrocarbons from the spent catalyst, prior to conveying the latter to a catalyst regenerator unit, an inert stripping gas, e.g., steam, is generally passed through the catalyst bed stripper where it removes such hydrocarbons conveying them to the product recovery zone. The spent catalyst includes deposited coke which is burned off in an oxygen-containing atmosphere in a regenerator to produce hot, regenerated catalyst. The fluidizable catalyst is continuously circulated between the reactor and the regenerator and serves to transfer heat from the latter to the former thereby supplying at least some of the thermal needs of the conversion reaction which is endothermic. The riser fluid cracking conversion conditions preferably include a temperature from about 950° F. (510° C.) to about 1250° F. (677° C.), more preferably 1000° F. (538° C.) to about 1200° F. (649° C.); a catalyst/oil weight ratio from about 0.01 to about 30, preferably from about 5 to about 20; a riser residence time of about 0.5 to 10 seconds, preferably about 1 to 5 seconds; and a weight hourly space velocity (WHSV) of about 1 to 20 $hr^{-1}$, preferably about 5 to 15 $hr^{-1}$. In using a dense fluid bed cracking process the temperature is preferably about 950° F. (510° C.) to about 1250° F. (677° C.), more preferably about 1000° F. (538° C.) to about 1200° F. (649° C.); with a catalyst residence time of about 0.5 to 60 minutes, preferably about 1.0 to 10 minutes.

Catalyst

The catalyst composition includes zeolite ZSM-5 (U.S. Pat. No. 3,702,886 and Re. 29,948) and/or ZSM-11 (U.S. Pat. No. 3,709,979). While previously, large pore zeolite with ZSM-5 additive were used in fluid catalytic cracking, the present invention uses only ZSM-5 and/or ZSM-11 without large pore zeolite. Preferably, relatively high silica zeolites are used, i.e., those with an initial silica/alumina molar ratio above about 5, and more preferably with a ratio of 20, 30 or higher, but not exceeding about 70 in the fresh catalyst. This ratio is meant to represent, as closely as possible, the molar ratio in the rigid framework of the zeolite crystal and to exclude silicon and aluminum in the matrix or in cationic or other form within the channels. Other metals besides aluminum which have been incorporated into the zeolite framework such as gallium can be used in the invention.

The preparation of the zeolite may require reduction of the sodium content, as well as conversion to the protonated form. This can be accomplished, for example by employing the procedure of converting the zeolite to an intermediate ammonium form as a result of ammonium ion exchange followed by calcination to provide the hydrogen form. The operational requirements of these procedures are well known in the art. The source of the ammonium ion is not critical; thus the source can be ammonium hydroxide or an ammonium salt such as ammonium nitrate, ammonium sulfate, ammonium chloride and mixtures thereof. These reagents are usually in aqueous solutions. By way of illustration, aqueous solutions of 1N $NH_4OH$, 1N $NH_4Cl$, and 1N $NH_4Cl/NH_4OH$ have been used to effect ammonium ion exchange. The pH of the ion exchange is not critical but is generally maintained at 7 to 12. Ammonium exchange may be conducted for a period of time ranging from about 0.5 to about 20 hours at a temperature ranging from ambient up to about 100° C. The ion exchange may be conducted in a single stage or in multiple stages. Calcination of the ammonium exchanged zeolite will produce its hydrogen form. Calcination can be effected at temperatures up to about 550° C.

The catalyst composition is also combined with a modifier which contains phosphorus. Incorporation of such a modifier in the catalyst of the invention is conveniently achieved by the methods described in U.S. Pat. No. 3,911,041 to Kaeding et al., U.S. Pat. No. 3,972,832 to Butter et al., U.S. Pat. No. 4,423,266 to Young et al., U.S. Pat. No. 4,590,321 to Chu U.S. Pat. No. 5,110,776 to Chitnis et al., and U.S. Pat. Nos. 5,231,064, 5,348,643 and 5,456,821 to Absil et al., the entire disclosures of which are incorporated herein by reference. Treatment with phosphorus-containing compounds can readily be accomplished by contacting the zeolite ZSM-5 and/or ZSM-11, either alone or in combination with a binder or matrix material, with a solution of an appropriate phosphorus compound, followed by drying and calcining to convert the phosphorus to its oxide form. Contact with the phosphorus-containing compound is generally conducted at a temperature in the range of about 25° C. to about 125° C. for a time between about 15 minutes and about 20 hours. The concentration of the phosphorus in the contact mixture may be between about 0.01 and about 30 wt. %.

After contacting with the phosphorus-containing compound, the catalyst material may be dried and calcined to convert the phosphorus to an oxide form. Calcination can be carried out in an inert atmosphere or in the presence of oxygen, for example, in air at a temperature of about 150 to 750° C., preferably about 300 to 500° C., generally for about 0.5 to 5 hours.

For use in catalytic conversion processes the zeolite is typically compounded with a substantially inert binder or matrix material for increased resistance to temperatures and other conditions, e.g., mechanical attrition, which occur in various hydrocarbon conversion processes such as an FCC process. It is generally necessary that the catalysts be resistant to mechanical attrition, that is, the formation of fines which are small particles, e.g., less than 20 micrometer. The cycles of reacting and regeneration at high flow rates and temperatures, such as in an FCC process, have a tendency to break down the catalyst into fines, as compared with an average diameter of catalyst particles. In a fluidized catalyst process, catalyst particles range from about 20 to about 200 micrometers, preferably from about 20 to about 120 micrometers. Excessive generation of catalyst fines increases the catalyst cost and can cause problems in fluidization and solids flow.

Preferably, the catalyst composition includes the zeolite ZSM-5 and/or ZSM-11 and a substantially inert matrix, generally inorganic oxide material. By inert is meant that the catalyst composition includes less than 20 wt. % active matrix material, preferably less than 10 wt. % active matrix material. The most commonly used active matrix material is alumina in its active form. Active alumina is generally made by peptidizing a dispersable alumina (e.g., formed from the Bayer process or by controlled hydrolysis of aluminum alcoholates) with acid (e.g., formic, nitric). The dispersed alumina slurry is then mixed into the matrix. However, the catalyst composition herein includes less than 20 wt. % active alumina, preferably less than 10 wt. % active alumina. Matrix materials particularly useful herein include silica and clay. Procedures for preparing silica bound ZSM-5 and/or ZSM-11 are described, e.g., in U.S. Pat. Nos. 4,582,815, 5,053,374 and 5,182,242 incorporated by reference herein. The matrix can be in the form of a cogel or sol. A mixture of these components can also be used. A silica sol is neutralized silicic acid (colloidal silica). The sol can comprise zero to about 60% by weight of the matrix. Preferably, the matrix comprises about 50 to about 100 wt. % clay and zero to about 50 wt. % sol.

The matrix can comprise up to 100% by weight clay. Naturally occurring clays which can be composited with the catalyst include the montmorillonite and kaolin families which include the subbentonites, and the kaolins commonly known as Dixie, McNamee, Georgia and Florida clays or others in which the main mineral constituent is halloysite, kaolinite, dickite, macrite or anauxite. Such clays can be used in the raw state as originally mined or initially subjected to calcination, acid treatment or chemical modification. Clay is generally used as a filler to produce denser catalyst particles. In addition to the foregoing materials, catalyst can be composited with a porous matrix material such as silica-magnesia, silica-zirconia, silica-magnesia-zirconia.

In general, the relative proportions of finely divided, crystalline zeolite component and matrix can vary widely, with the zeolite ZSM-5 and/or ZSM-11 content ranging from about 1 to about 90 percent by weight, and more usually from about 2 to about 80 weight percent of the composite. Preferably, the zeolite ZSM-5 and/or ZSM-11 makes up about 5 to about 75 wt. % of the catalyst and the matrix makes up about 95 to about 25 wt. % of the catalyst.

The catalyst containing the zeolite ZSM-5 and/or ZSM-11, and a substantially inert binder (e.g. clay), can be prepared in fluid form by combining a zeolite ZSM-5 and/or ZSM-11 slurry with a clay slurry. Phosphorus can be incorporated by any of the methods known in the art, as discussed more fully above. Preferably, the amount of phosphorus incorporated into the catalyst is about 0.5 to 10 wt % of the catalyst. The fluid catalyst mixture can then be spray dried. Optionally, the spray dried catalyst can be calcined in air or an inert gas and steamed under conditions well known in the art to adjust the initial acid-catalyzed activity of the catalyst.

In an embodiment of the present invention, the catalyst composition may include metals useful in promoting the oxidation of carbon monoxide to carbon dioxide under catalyst regeneration conditions as described in U.S. Pat. Nos. 4,072,600 and 4,350,614, the entire contents of each incorporated herein by reference. Examples of this embodiment include addition to the catalyst composition for use herein trace amounts of oxidation promoter selected from the group consisting of platinum, palladium, iridium, osmium, rhodium, ruthenium, rhenium, and combination thereof. The catalyst composition may comprise, for example, from about 0.01 ppm to about 100 ppm by weight oxidation promoter, usually from about 0.01 ppm to about 50 ppm by weight, preferably from about 0.01 ppm to about 5 ppm by weight.

Products

The products of the catalytic conversion process include light olefins and aromatics. The product also preferably includes propylene and a higher amount of ethylene than is usually obtained in conventional catalytic cracking processes. The product includes an ethylene/propylene weight ratio greater than about 0.39, preferably greater than about 0.6 as percentages of the product yield based on total feed. Typically, the use of a diluent with the feed, e.g. steam, in connection with the process of the present invention, will increase the product ethylene/propylene ratio by lowering the partial pressure of the hydrocarbon feed. A substantial amount of propylene is also produced, so that the amount of ethylene plus propylene is greater than about 20 wt. %, preferably greater than about 25 wt. %, more preferably greater than 30 wt. % as a percentage of the product based on total feed. The product can include less than 10 wt %, preferably less than about 8 wt % and more preferably less than about 6 wt % methane plus ethane.

The $C_4$+ naphtha hydrocarbon conversion is generally from about 20% to about 90% of the feed, preferably 40% to 70%. The amount of coke produced generally increases with conversion conditions.

The following non-limiting examples illustrate the invention. These examples include the preparation of a base catalyst to be used in comparative examples, the preparation of two catalysts in accordance with the invention and use of the catalysts to catalytically convert a light catalytic naphtha feed.

EXAMPLE 1

Catalysts were prepared as follows:

Catalyst A: This catalyst consisted of about 40 wt % of a 450:1 $SiO_2/Al_2O_3$ ZSM-5 in a binder comprising kaolin clay. The catalyst was prepared in fluid form by combining a slurry of the ZSM-5 with a kaolin clay slurry. Prior to combining the two slurries, about 4-wt % phosphorus (based on total weight of finished catalyst) was added via phosphoric acid to the ZSM-5 slurry. After spray drying, the catalyst was calcined at 1150° F. (620° C.) in air for 45 minutes and subjected to cyclic propylene steaming (CPS) to simulate equilibrated catalyst. The equilibrium catalyst or Ecat in a continuous fluidized bed process is generated by circulation between reaction and regeneration environments and the rate of makeup/withdrawal of fresh/aged catalyst. The CPS procedure consisted of exposing the catalyst at 1435° F. (779° C.) for 20 hours at 35 psig (3.4 bar) in the following cyclic environment: (1) 50 vol % steam and the balance nitrogen for 10 minutes, (2) 50 vol % steam and the balance containing a mixture of 5% propylene and 95% nitrogen for 10 minutes, (3) 50 vol % steam and the balance nitrogen for 10 minutes and (4) 50 vol % steam and the balance air for 10 minutes.

Catalyst B: This catalyst consisted of about 40-wt % of a 26:1 $SiO_2/Al_2O_3$ ZSM-5, with 30 wt % clay and 30 wt % silica in its binder. The catalyst was prepared in fluid form similar to Catalyst A, with 3.0 wt % phosphorus (based on total weight of finished catalyst) added to the zeolite slurry mixture prior to mixing with the clay slurry and spray drying. After spray drying, the catalyst was calcined for 3 hours at 1000° F. (538° C.) in air and CPS steamed using the procedure for Catalyst A.

Catalyst C: This catalyst consisted of about 44 wt % of a 26:1 $SiO_2/Al_2O_3$ ZSM-5, with 28 wt % clay and 28 wt % silica in its binder. The catalyst was prepared in fluid form similar to Catalyst A, with 2.8 wt % phosphorous (based on total weight of finished catalyst) added to the zeolite slurry mixture prior to combining with the clay/silica slurry, and spray drying. After spray drying, the catalyst was rotary calcined for 90 minutes at 1000° F. (538° C.) in air and CPS steamed using the procedure for Catalyst A.

Catalyst properties are shown in Table 1.

TABLE 1

| Name | Catalyst A | Catalyst B | Catalyst C |
|---|---|---|---|
| Zeolite | ZSM-5 | ZSM-5 | ZSM-5 |
| $Si/Al_2$ (mol/mol) | 450:1 | 26:1 | 26:1 |
| Spray Dry Formulation | | | |
| Zeolite, wt % (P-free) | 40 | 40 | 44 |
| Clay, wt % (P-free) | 60 | 30 | 28 |
| $SiO_2$, wt % (P-free) | 0 | 30 | 28 |
| $Al_2O_3$, wt % (P-free) | 0 | 0 | 0 |
| P wt % | 4.5 | 3 | 2.8 |
| Calcined Catalyst | | | |
| Surface Area (SA) $m^2/gm$ | N.A. | 120 | 148 |
| Ash, wt % | N.A. | 99.5 | 98.5 |
| Silica, wt % | N.A. | 73.5 | 77.2 |
| Alumina, wt % | N.A. | 16.5 | 13.3 |
| Phosphorus, wt % | 3.9 | 2.5 | 2.7 |
| Steaming Conditions | | | |
| Temperature, ° F./ ° C. | 1435/7790 | 1435/779 | 1435/779 |
| Steam Atm, % | 50 | 50 | 50 |
| Pressure, psig | 35 | 35 | 35 |
| Time, hours | 20 | 20 | 20 |
| CPS? | Yes | Yes | Yes |
| Steamed Catalyst | | | |
| Surface Area (SA) $m^2/gm$ | 137 | 136 | 174 |

EXAMPLE 2

The catalysts prepared in Example 1 were used in a fixed-fluid-bed unit to convert a light catalytic naphtha (LCN) hydrocarbon feed. Feed properties are listed in Table 2.

TABLE 2

| | |
|---|---|
| C4= , wt % | 1.7 |
| C4, wt % | 0.3 |
| C5= , wt % | 25.6 |
| C5 PN, wt % | 18.5 |
| C6= , wt % | 15.5 |
| C6 PN, wt % | 13.9 |
| C7= , wt % | 7.7 |
| C7 PN, wt % | 6.1 |
| C8 Plus + Unknowns, wt % | 4.7 |
| Benzene, wt % | 2.1 |
| Toluene, wt % | 2.8 |
| Xylene, wt % | 1.0 |
| Ethyl-benzene, wt % | 0.2 |
| Sum | 99.8 |

A 15 gram sample of Catalyst A was loaded in a bench-scale fixed fluid bed (FFB) reactor and contacted with the LCN feed under the following operating conditions: reactor temperature was 1100° F. (593° C.), operating pressure was 30 psig (3.1 bar), and the WHSV of the LCN feed was 5.9 hr. A sample of the effluent from the reaction zone after 8 hours on stream was collected, separated into a gas and liquid product, and analyzed using standard GC techniques. The yield (lbs. product per lb. of feed) of ethylene was 5.3 wt %, and the yield of propylene was 18.4 wt %. There was also some production of aromatics. At the conclusion of the run, the catalyst contained 5.7 wt % coke.

The process conditions and products are listed in Table 3 below.

Example 2 reveals that when a LCN feed was delivered to a FFB reactor containing Catalyst A, under conversion conditions, there was significant production of ethylene and propylene.

EXAMPLE 3

A 115 gram sample of Catalyst A was loaded in the bench-scale FFB reactor and contacted with the LCN feed at an average temperature of 1172° F. (633° C.) (with catalyst starting temperature of 1200° F. (649° C.)). The WHSV of the LCN feed was 6 hr with a 15 wt % steam co-feed. The run length was 120 seconds corresponding to a catalyst/oil ratio of 5. The total effluent from the reaction zone was collected over the entire run length and then separated into a gas and liquid product and analyzed using standard GC techniques. The yield (lbs. product per lb. of feed) of ethylene was 7.7 wt %, and the yield of propylene was 18.0 wt %. There was also a production of aromatics similar to Example 2. The catalyst contained 0.021 wt % coke at the end of the run, corresponding to a coke yield on feed of 0.1 wt %.

The process conditions and products are listed in Table 3 below.

A comparison of Examples 2 and 3 reveals that the yield of ethylene was increased in Example 3 by operating at a higher temperature, lower hydrocarbon partial pressure (due to the steam co-feed) and higher catalyst/oil ratio.

EXAMPLE 4

A 115-gram sample of Catalyst B was loaded in the bench-scale FFB reactor and contacted with the LCN feed at an average temperature of 1165° F. (629° C.) (with catalyst starting temperature of 1200° F. (649° C.)). Similar to Example 3, the WHSV of the LCN feed was 6 $hr^{-1}$ with 15 wt % steam co-feed. The run length was 120 seconds corresponding to a catalyst/oil ratio of 5. The yield (lbs. product per lb. of feed) of ethylene was 11.8 wt % and the yield of propylene was 19.0 wt %. There was a substantial increase of xylene and toluene, but a decrease of benzene compared with Examples 2 and 3. The catalyst at the end of the run contained 0.024 wt % coke, corresponding to a coke yield on feed of 0.12 wt %. The process conditions and products are listed in Table 3 below.

The use of Catalyst B in Example 4, under similar operating conditions to Example 3, resulted in a significant increase in the yield of ethylene. The yield of ethylene was more than twice that of Example 2 and significantly more than Example 3. Also, there was a significant increase in both toluene and xylene in Example 4.

EXAMPLE 5

A 115-gram sample of Catalyst B was loaded in the bench-scale FFB reactor and contacted with the LCN feed at an average temperature of 1193° F. (645° C.) (with catalyst starting temperature of 1200° F. (649° C.)). Similar to Example 4, the WHSV of the LCN feed was 6 $hr^{-1}$ with a 15 wt % steam co-feed; however, the run length was 40 seconds corresponding to a catalyst/oil ratio of 16. The yield (lbs. product per lb. of feed) of ethylene was 16.3 wt % and the yield of propylene was 21.2 wt %. The catalyst at the end of the run contained 0.024 wt % coke, corresponding to a coke yield on feed of 0.39 wt %. The process conditions and products are listed in Table 3 below.

Example 5 reveals a further increase in the yield of ethylene over Example 4, by increasing the catalyst/oil ratio from 6 to 16. Also, similar to Example 4, there was a decrease in benzene yield, but an increase of xylene and toluene compared with Examples 2 and 3.

EXAMPLE 6

A 14 gram sample of Catalyst C was loaded in the bench-scale FFB reactor and contacted with the LCN feed at a temperature of about 100° F. (593° C.). The WHSV of the LCN feed was maintained at 5.7 $hr^{-1}$. A sample of the effluent from the reactor was collected after 11 hours on stream, separated into a gas and liquid product, and analyzed using standard GC techniques. The yield of ethylene was 7.9 wt %, and the yield of propylene was 19.8 wt %. There was also some production of aromatics. After 15 hours on stream the run was terminated and the aged catalyst contained 7.7 wt % coke. The process conditions and products are listed in Table 3 below.

Example 6 reveals that when the LCN feed was delivered to the FFB reactor in the presence of Catalyst C, and without a steam co-feed, there was significant production of ethylene and propylene, with very small amounts of ethane and methane produced, after 11 hours on stream. There was also increases in both xylene and toluene relative to the feed.

TABLE 3

| | Catalyst Base Case | | Invention | | Invention |
|---|---|---|---|---|---|
| Catalyst | A | | F | | C |
| $Si/Al_2$ (mol/mol) | 450 | | 26 | | 26 |
| | Example 2 | Example 3 | Example 4 | Example 5 | Example 6 |
| Temperature, ° F./ ° C. | 1100/593 | 1172/633 | 1165/629 | 1193/645 | 1103/595 |
| WHSV, $hr^{-1}$ | 5.9 | 5.9 | 6 | 6 | 5.7 |
| Cat/Oil ratio | 0.02 | 5 | 5 | 16 | 0.02 |
| HC Partial Pres., psia/bar | 45/3.1 | 9.7/0.7 | 9.7/0.7 | 9.7/0.7 | 16.4/1.1 |
| $H_2O$ Co-feed, wt % Feed | 0 | 15 | 15 | 15 | 0 |
| Products, weight % | | | | | |
| $H_2$ | 0.1 | 0.1 | 0.2 | 0.3 | 0.1 |
| $C_1$ | 2.0 | 1.5 | 1.6 | 3.0 | 0.6 |
| $C_2$= | 5.3 | 7.7 | 11.8 | 16.3 | 7.9 |
| $C_2$ | 1.6 | 0.9 | 1.8 | 2.8 | 0.8 |
| $C_3$= | 18.4 | 18.0 | 19.0 | 21.2 | 19.8 |
| $C_3$ | 2.2 | 0.7 | 3.2 | 3.1 | 2.1 |
| $C_2$= + $C_3$= | 23.7 | 25.7 | 30.8 | 37.5 | 27.7 |
| $C_4$= | 13.2 | 8.3 | 8.9 | 9.6 | 11.0 |
| $C_4$ | 1.4 | 0.6 | 1.6 | 1.5 | 1.4 |
| $C_5$= | 7.5 | 7.6 | 3.2 | 3.0 | 5.2 |
| $C_5$ PN | 14.4 | 11.8 | 7.6 | 7.5 | 13.6 |
| $C_6$= | 1.6 | 2.3 | 1.0 | 0.7 | 1.2 |
| $C_6$ PN | 9.9 | 10.2 | 5.3 | 3.6 | 11.5 |
| $C_7$= | 1.7 | 2.3 | 1.2 | 0.8 | 1.6 |
| $C_7$ PN | 4.3 | 6.4 | 4.7 | 3.2 | 5.3 |
| $C_8$ Plus + Unknowns | 7.3 | 11.5 | 12.3 | 11.8 | 8.1 |
| Benzene | 2.3 | 2.3 | 2.0 | 1.4 | 2.1 |
| Toluene | 4.6 | 4.8 | 7.9 | 5.4 | 4.5 |
| Xylene | 1.8 | 2.7 | 6.3 | 4.3 | 2.7 |
| Ethyl-benzene | 0.6 | 0.4 | 1.0 | 0.7 | 0.5 |
| Sum | 100.0 | 100.0 | 100.5 | 100.0 | 100.0 |

Table 3 illustrates that the yields of ethylene for Catalyst B were significantly greater than for Catalyst A. Additionally, the yields of propylene, as well as toluene, xylene and ethyl-benzene, were greater for Catalyst B. The use of Catalyst C, without the addition of steam in the feed, again resulted in higher production of both ethylene and propylene, relative to Catalyst A. Moreover, the ethylene production appears to be a result of catalytic conversion by both Catalyst B and Catalyst C, and not due to thermal cracking, since the amount of dry gas (methane and ethane) was relatively low in both cases.

While there have been described what are presently believe preferred embodiments of the invention, those skilled in the art will realize that changes and modifications may be made thereto without departing from the spirit of the invention and it is intended to claim all such changes and modifications as fully within the true scope of the invention.

We claim:

1. A process for converting a $C_4$+ naphtha hydrocarbon feed to a product which includes light olefins and aromatics, comprising:

contacting said feed with a catalyst comprising ZSM-5, ZSM-11 or combinations thereof treated with a phosphorus-containing compound, and a substantially inert matrix material, wherein said catalyst contains less than 20 wt % of active matrix material and has an initial silica/alumina molar ratio between about 5 and about 30, said contacting being effected under conditions to produce a product containing light olefins and aromatics.

2. The process of claim 1 wherein the $C_4$+ naphtha hydrocarbon feed includes feeds having boiling point ranges from about 80° F. (27° C.) up to about 430° F. (221° C.).

3. The process of claim 1 wherein the zeolite makes up about 5 to 75 wt. % of the catalyst, the substantially inert matrix material makes up about 25 to about 95 wt. % of the catalyst and phosphorus is present in amount of about 0.5 to 10 wt. % of the catalyst.

4. The process of claim 1 wherein the substantially inert matrix material comprises silica, clay or mixtures thereof.

5. The process of claim 1 wherein said conditions comprise a temperature of from about 950° F. (510° C.) up to about 1300° F. (704.4° C.), a hydrocarbon partial pressure from about 2 to about 115 psia (0.1 to about 8 bar), a catalyst/hydrocarbon feed weight ratio form about 0.01 to about 30, and a WHSV from about 1 to about 20 $hr^{-1}$.

6. The process of claim 1 wherein the product comprises ethylene and propylene, with a $C_2$=/$C_3$=wt. ratio greater than 0.39, and increased amounts of toluene and xylene relative to the hydrocarbon feed.

7. The process of claim 1 further comprising co-feeding steam under conversion conditions in am amount from about 5 to about 30 wt % of the steam/feed mixture.

8. The process of claim 7 wherein the product comprises ethylene and propylene, with a $C_2$=/$C_3$=wt. ratio greater than about 0.6, and increased amounts of toluene and xylene relative to the hydrocarbon feed.

9. The process of claim 1 wherein the light olefins in the product comprise ethylene plus propylene in an amount greater than about 25 wt. % based on total product.

* * * * *